US007918552B2

(12) United States Patent
Ageishi

(10) Patent No.: US 7,918,552 B2
(45) Date of Patent: Apr. 5, 2011

(54) INKJET CONVEYING BELT AND INKJET RECORDING APPARATUS

(75) Inventor: Kentaro Ageishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 681 days.

(21) Appl. No.: 11/546,777

(22) Filed: Oct. 12, 2006

(65) Prior Publication Data

US 2007/0268350 A1 Nov. 22, 2007

(30) Foreign Application Priority Data

May 17, 2006 (JP) ..... 2006-137746

(51) Int. Cl.
*B41J 2/01* (2006.01)

(52) U.S. Cl. ..... 347/104; 347/103

(58) Field of Classification Search ..... 347/102, 347/103, 104, 105

See application file for complete search history.

(56) References Cited

U.S. PATENT DOCUMENTS

| | | | | |
|---|---|---|---|---|
| 4,937,105 | A | 6/1990 | Sakai et al. | |
| 5,896,154 | A * | 4/1999 | Mitani et al. | 347/102 |
| 6,284,373 | B1 * | 9/2001 | Ream et al. | 428/379 |
| 6,652,938 | B1 * | 11/2003 | Nishikawa et al. | 428/35.9 |
| 7,050,731 | B2 * | 5/2006 | Bannai et al. | 399/49 |
| 2001/0044025 | A1 * | 11/2001 | Ream et al. | 428/379 |
| 2002/0110381 | A1 * | 8/2002 | Maebashi et al. | 399/49 |
| 2006/0045580 | A1 * | 3/2006 | Matsuura | 399/316 |
| 2006/0050124 | A1 | 3/2006 | Adachi | |
| 2006/0051140 | A1 * | 3/2006 | Shimomura et al. | 399/303 |

FOREIGN PATENT DOCUMENTS

| | | | |
|---|---|---|---|
| JP | 01-185688 | | 7/1989 |
| JP | 2001-301083 | | 10/2001 |
| JP | 2002-012681 | | 1/2002 |
| JP | 2003-103857 | | 4/2003 |
| JP | 2003-146470 | | 5/2003 |
| JP | 2004045916 | * | 2/2004 |
| JP | 2005015227 A | * | 1/2005 |
| JP | 2005-053663 | | 3/2005 |
| JP | 2006-103022 | | 4/2006 |

* cited by examiner

*Primary Examiner* — Manish S Shah
(74) *Attorney, Agent, or Firm* — Fildes & Outland, P.C.

(57) ABSTRACT

A single-layer seamless inkjet conveying belt including a polyimide resin or a polyamide-imide resin as a resin component and a conductive filler, the inkjet conveying belt having a volume resistivity of $10^{10}$ to $10^{14}$ Ωcm. Also provided is an inkjet recording apparatus including a recording medium conveying device containing the inkjet conveying belt and a recording head that discharges ink droplets onto a recording medium.

14 Claims, 7 Drawing Sheets

INKJET CONVEYING BELT AND INKJET RECORDING APPARATUS

BACKGROUND

1. Technical Field

The present invention relates to an inkjet conveying belt and an inkjet recording apparatus.

2. Related Art

Conventionally, in an inkjet recording apparatus, an image is formed on a recording medium by discharging ink fluid while moving the inkjet head in a primary scanning direction, and when the movement of the inkjet head for one line is completed, the recording medium is conveyed by a predetermined distance in a secondary scanning direction, and the inkjet head is moved in the primary scanning direction again. Since the recording medium has to be conveyed accurately by a predetermined distance, the conveying belt is charged, and the recording medium is conveyed by adsorbing the recording medium on the surface of the conveying belt as a result of static electricity.

SUMMARY

An aspect of the invention provides a single-layer seamless inkjet conveying belt including a polyimide resin or a polyamide-imide resin as a resin component and a conductive filler, the belt having a volume resistivity of $10^{10}$ to $10^{14}$ Ωcm.

BRIEF DESCRIPTION OF THE DRAWINGS

Embodiments of the present invention will be described in detail based on the following figures, wherein:

FIGS. 1A and 1B are drawings explaining a flow coating method, wherein FIG. 1A is a schematic view showing a method of applying a polyimide precursor solution to an outer circumferential face of a cylindrical core body, and FIG. 1B is a cross-sectional view of a coated portion of the cylindrical core body described in FIG. 1A;

BEST MODE FOR CARRYING OUT THE INVENTION

Figure 1A:
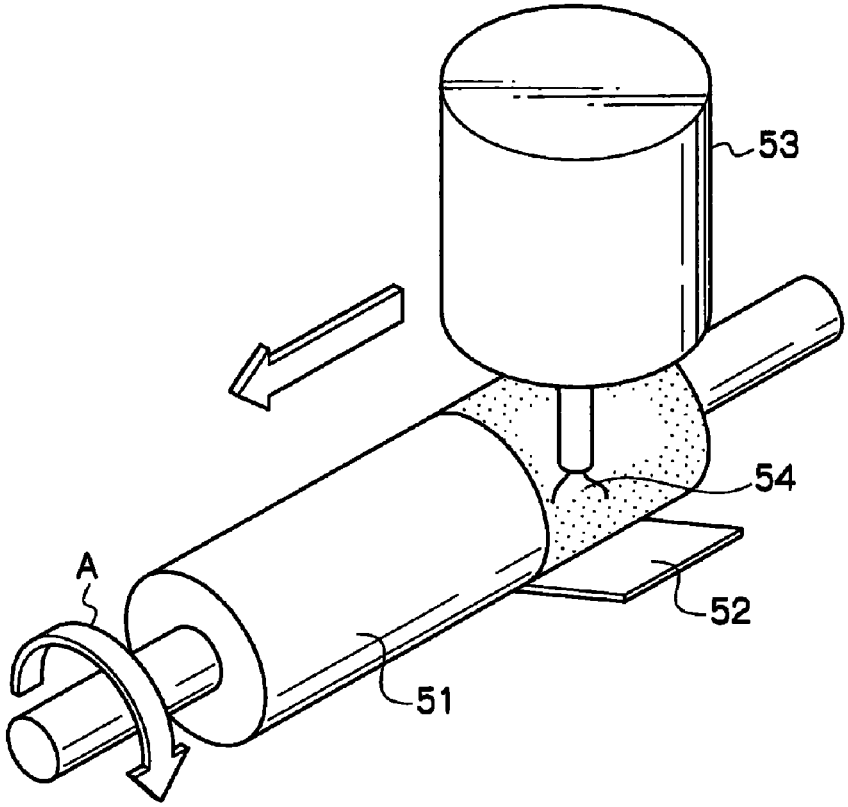

According to an aspect of the invention, there is provided a single layer seamless inkjet conveying belt that includes a polyimide resin or a polyamide-imide resin as a resin component and a conductive filler, the volume resistivity of the inkjet conveying belt being in the range of $10^{10}$ to $10^{14}$ Ωcm.

The inkjet conveying belt may have surface smoothness that gives a gloss of 75 or more (at angle of incidence of 75 degrees), and a thickness of 30 to 1000 μm. Furthermore, the inkjet conveying belt of the present invention may be manufactured by any one of; a flow coating method, a ring flow coating method, and a centrifugal molding method.

According to another aspect of the invention, there is provided an inkjet recording apparatus including a recording medium conveying device that has the above-mentioned inkjet conveying belt of the present invention, and a recording head that discharges ink droplets onto a recording medium.

[Inkjet Conveying Belt]

The inkjet conveying belt of the present invention is a single layer seamless belt form containing at least one species amongst polyimide resins and polyamide-imide resins as a resin component, and furthermore, containing a conductive filler, and wherein the volume resistivity of the inkjet conveying belt is $10^{10}$ to $10^{14}$ Ωcm.

As a result of being a single layer seamless belt form and containing the resin component mentioned above, the residual distortions at the time of formation are removed due to solvent removal at the time of film production and crosslinking at the time of imidation, dimensional changes and swell bending at the time of environmental change may be lessened, and circumference changes may be decreased. Furthermore, by using the resin mentioned above, it is possible to cope with paper retention and color registration while controlling the film thickness changes (<1%). Also the effect of residual electric charge resulting from the history of belt charging is low, so that the inkjet conveying belt can be used without a discharging process.

Furthermore, by containing a conductive filler and making the volume resistivity $10^{10}$ to $10^{14}$ Ωcm$^2$, accumulation of residual electric charge resulting from continuous use at the time of charging may be prevented, and it becomes possible to achieve both a stable paper adsorptivity and detachability. Furthermore, from the viewpoint of; maintaining paper adsorptivity, detachability, suppressing changes in belt speed, uniformity of the belt charge, and lowering the discharge at detaching, it is preferable for the surface resistivity to be $10^{11}$ to $10^{14}$ Ωcm$^2$, and it is more preferable for it to be $10^{11}$ to $10^{14}$ Ωcm$^2$. As a result of the surface resistivity being $10^{11}$ to $10^{14}$ Ω/cm$^2$, it is possible to maintain a stable surface charge, provide dischargability, and to stabilize the paper orientation.

The inkjet conveying belt preferably has surface smoothness that gives a gloss of 75 or more (at angle of incidence of 75 degrees), and more preferably 80 to 130. In regard to the thickness of the inkjet conveying belt, 30 to 1000 μm is preferable, and 50 to 200 μm is more preferable. By making the surface smoothness 75 or more, and the thickness from 30 to 1000 μm, it becomes possible to made a stable surface quality as a result of an improvement in the cleaning characteristics of the blade and the like, due to a reduction in undulations resulting from belt thickness deviations, a reduction in curling tendencies, and a reduction in ink adhesion on the surface.

The surface smoothness can be measured by the Rz (10 point average roughness) according to a surface roughness meter, or the surface reflectance according to a digital precision gloss meter (angle of incidence 20 to 75°).

The polyimide resin and the polyamide-imide resin for the resin component may utilize one that is conventionally known.

For example, for the polyimide resin coating utilized in the present invention, there are no particular restrictions as long as it is a combination of a carboxylic acid and a diamine component, though in particular, one that is obtained by reacting an aromatic tetracarboxylic acid component and an aromatic diamine component in an organic solvent is preferably used.

Examples of the aromatic tetracarboxylic acid component include; pyromellitic acid, naphthalene-1,4,5,8-tetracarboxylic acid, 2,2',3,3'-biphenyltetracarboxylic acid, naphthalene-2,3,6,7-tetracarboxylic acid, 2,3,5,6-biphenyltetracarboxylic acid, 3,3',4,4'-diphenylethertetracarboxylic acid, 3,3',4,4'-benzophenonetetracarboxylic acid, 3,3',4,4'-diphenyltetracarboxylic acid, 3,3',4,4'-diphenylsulfonetetracarboxylic acid, 3,3',4,4'-azobenzenetetracarboxylic acid, bis(2,3-dicarboxyphenyl)methane, bis(3,4-dicarboxyphenylmethane), bis(3,4-dicarboxyphenylpropane), and bis(3,4-dicarboxyphenyl) hexafluoropropane, and it may be a mixture of acids selected from these tetracarboxylic acid species.

There are no particular restrictions on the aromatic diamine component, and examples include; m-phenyldiamine, p-phenyldiamine, 2,4-aminotoluene, 2,6-aminotoluene, 2,4-diaminochlorobenzene, m-xylylenediamine, p-xylylenediamine, 1,4-diaminonaphthalene, 1,5-diaminonaphthalene, 2,6-diaminonaphthalene, 2,4'-diaminonaphthalenebiphenyl, benzidine, 3,3-dimethylbenzidine, 3,3'-dimethoxybenzidine, 3,4'-diaminodiphenylether, 4,4'-diaminodiphenylether (ODA) 4,4'-diaminodiphenylsulfide, 3,3'-diaminobenzophenone, 4,4'-diaminophenylsulfone, 4,4'-diaminoazobenzene, 4,4'-diaminodiphenylmethane, and bis(aminophenyl)propane.

Examples of the organic solvent include N-methyl-2-pyrrolidone, N,N-dimethylacetoamide, dimethylsulfoxide, and hexamethylphosphonyltriamide. According to need, phenol species such as cresol, phenol, and xylenol, and hydrocarbon species such as hexane, benzene, and toluene, may be mixed. Furthermore, these may be used as a single component, or as a mixture of two or more components.

Examples of the electron conducting material for a conductive filler include: fillers such as carbon black, graphite, Al, Ni, and copper, and complex oxides such as tin oxide, zinc oxide, titanic acid K, tin oxide-indium oxide, and antimony oxide. Furthermore, examples of the ion conducting material include; surface active materials of ammonium salts, sulfonates, cations, nonions, and anions. Then, by appropriately using these, the volume resistivity is controlled to $10^{10}$ to $10^{14}$ Ωcm. The content of the conductive filler depends on the desired volume resistivity, and the like, although it is preferable for it to be 1 to 50 mass % within the inkjet conveying belt.

The volume resistivity and the surface resistivity can be measured using a circular electrode (for example, the "HRS Probe" of a HIRESTA-IP manufactured by Mitsubishi Petrochemical Co. Ltd.) under an environment of 23° C., and 55% RH. As the measurement conditions, for example, a load of 1.0 kg, a voltage of 100 V, and a charge time of 10 seconds is used.

The inkjet conveying belt of the present invention is manufactured via; a coating process that spreads and applies the polyimide resin composition or the polyamide resin on the inner circumferential face or the outer circumferential face of the metallic cylindrical core body, a curing process that thermally cures this (for example, at 380° C., 1 hour) and produces the film, and a separation process that separates the produced cylinder-shaped film.

As the coating method in the coating process, it is possible to employ one amongst; the flow coating method, the ring flow coating method, and the centrifugal molding method, from the viewpoint of; maintaining the surface leveling, suppressing the appearance like dry-skin, the reduction of film thickness, and the reduction of distortions at the time of formation. Hereunder, using the case of the polyimide resin as an example, these application methods are explained. In the present specification, polyimide may also be referred to as "PI".

<Application Processes>

(Flow Coating Method)

The flow coating method is preferable from the point that a polyimide precursor solution (which is made to be one containing the conductive filler) can be efficiently and reasonably applied at substantially a uniform thickness. Such a preferable application method of the polyimide precursor solution is explained using the drawings.

Figure 1B:
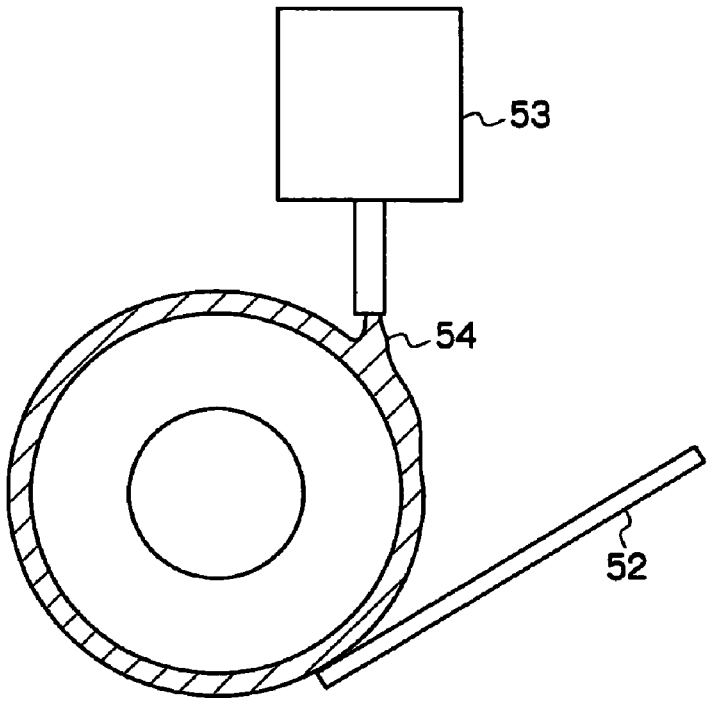

FIG. 1A is a schematic view showing a method of applying the polyimide precursor solution according to the present invention to the outer circumferential face of a cylindrical core body, in which the surface water contact angle has been controlled. On the other hand, FIG. 1B is a cross-sectional view of the coated portion of the cylindrical core body described in FIG. 1A. In FIG. 1, reference numeral 51 denotes a cylindrical core body in which the surface water contact angle has been controlled, 52 denotes a plate, 53 denotes a container, and 54 denotes a polyimide precursor solution.

This method is one which drips a fixed amount of the polyimide precursor solution 54 on the surface of the cylindrical core body 51 from the container 53 accommodating the polyimide precursor solution 54, while the cylindrical core body 51 is rotated at a fixed speed in the direction of the arrow A and the coated polyimide precursor solution 54 is flattened by the plate 52 that makes contact with the surface of the cylindrical core body 51, so that the polyimide precursor solution is applied. As a result, a uniformly flattened polyimide precursor solution 54 is applied on the surface of the cylindrical core body 51.

(Ring Flow Coating)

Ring flow coating is a method in which the coating is formed while the film thickness is controlled by an annular body, and it is preferable from the point that controlling the film thickness is easy, adjustments resulting from the discharge amount and the rotation speed can be made, and the method is capable of applying the coating solution on both a large diameter belt and a small diameter belt. Hereunder, it is explained in detail with reference to FIG. 2 and FIG. 3.

Figure 2:
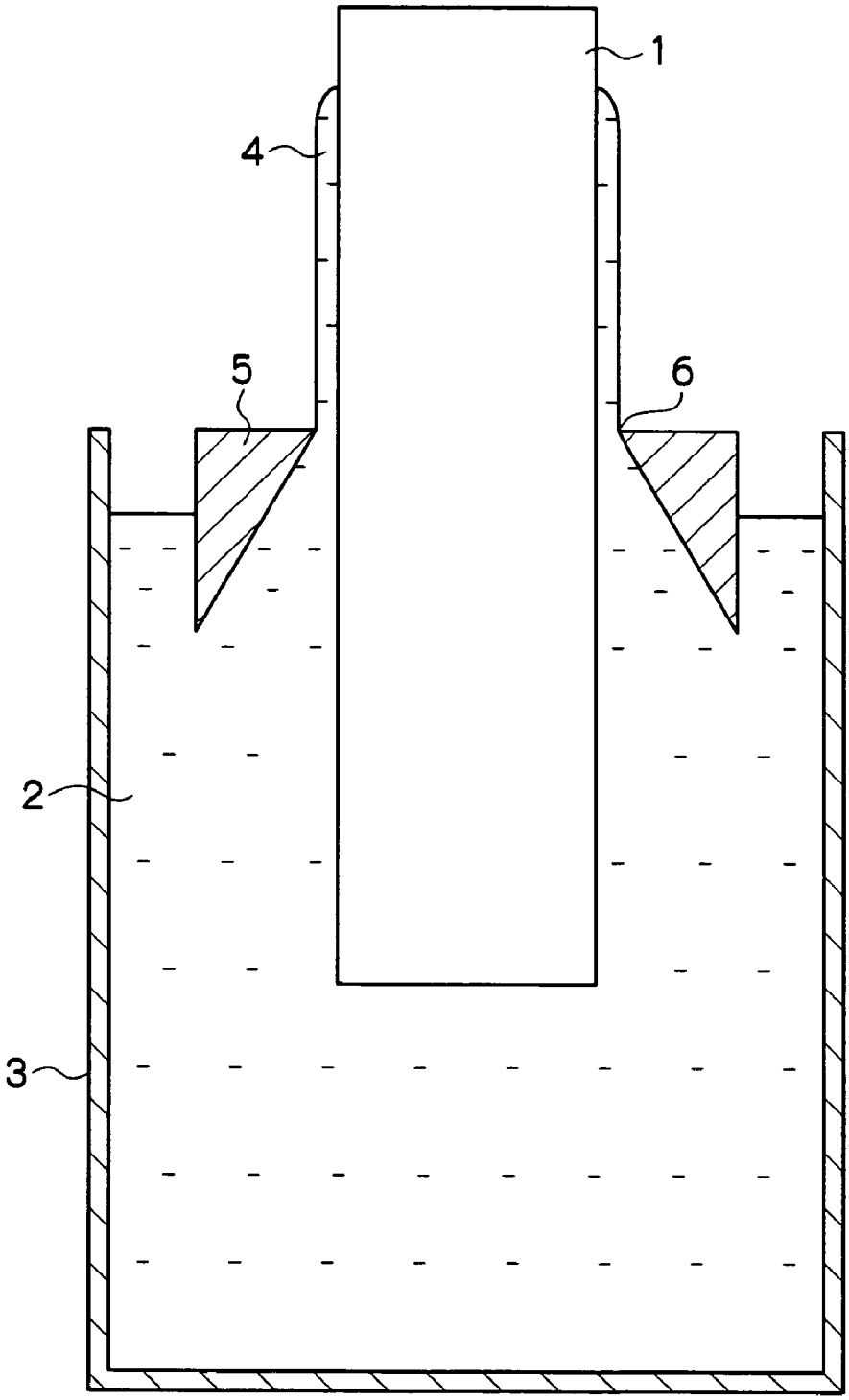
FIG. 2 is an outline cross-sectional view showing an example of a device used in a dip coating method in which film thickness is controlled by a cylindrical body.

FIG. 2 is an outline cross-sectional view showing an example of a device used in the dip coating method which controls the film thickness by an annular body. However, the drawing shows only the essential portions for application, and the rest of the device is omitted.

This dip coating method, as shown in FIG. 2, is an application method that; floats an annular body 5, which is provided with a circular hole 6 that is larger than the outer diameter of the cylindrical core body 1 that has a transferred portion formed thereto, in a PI precursor solution 2 that has been placed in a dip coating tank 3, dips the cylindrical core body 1 into the PI precursor solution 2 by passing it through the hole 6, and then raises it.

The material of the annular body 5 is selected from metals, plastics, and the like, that are not attacked by the PI precursor solution 2. Furthermore, it may be a hollow construction such that it is easy to float, and in order to prevent sinking, legs and arms that support the annular body 5 may be provided on the outer circumferential face of the annular body 5 or the dip coating tank 3.

The annular body 5 is installed such that it is freely movable in the horizontal direction, by a method such as a method in which it is floated on the PI precursor solution 2, or in which the annular body 5 is supported by rolls or bearings, or a method in which the annular body 5 is supported by air pressure, such that it can move on the PI precursor solution 2 under a slight force. Furthermore, the annular body 5 can be temporarily fixed such that it is positioned in the central portion of the dip coating tank 3.

Since the film thickness of the PI precursor coating 4 is controlled by the spacing between the outer diameter of the cylindrical core body 1 and the diameter of the hole 6, the inner diameter of the hole 6 is adjusted according to the desired film thickness. Since the film thickness uniformity of the PI precursor coating 4 is also determined by the spacing, the circularity of the hole is important. If the circularity is low, the film thickness uniformity decreases, and the quality of the PI resin endless belt also deteriorates. Therefore, it is preferable for the circularity to be 20 μm or less, and it is more preferable for it to be 10 μm or less. Of course, a circularity of 0 μm is ideal, but this is difficult in processing.

Regarding the inner wall face of the hole 6, if it is a shape in which the lower portion that is soaked in the PI precursor solution 2 is wide and the upper portion is narrow, then as shown in FIG. 2, it is acceptable if it is an inclined face that is diagonally linear, or one comprising combined inclined faces. Furthermore, it may be step shaped or curved.

When the application is performed, the cylindrical core body 1 is raised through the hole 6. The raising speed may be of the order of 0.1 to 1.5 nm/min. The solid concentration of the PI precursor solution 2 for this application method may be 10 to 40 mass %, and the viscosity may be 1 to 100 Pa·s.

When the cylindrical core body 1 is raised through the hole 6, since the annular body 5 is freely movable in the horizontal direction, the annular body 5 moves such that the frictional resistance between the cylindrical core body 1 and the annular body 5 becomes constant in the circumferential direction, and a PI precursor coating 4 with a uniform film thickness is formed on the surface of the cylindrical core body 1.

Furthermore, in the application device used in the dip coating method there may be provided: a cylindrical core body maintenance device for maintaining the cylindrical core body 1, a first movement device for moving the maintenance device in the vertical direction, and/or a second movement device for moving the dip coating tank 3 in the vertical direction.

In this manner, by applying the dip coating method that controls the film thickness by means of the annular body 5 and using a high viscosity PI precursor solution 2, running down of the coating at the upper end portion of the cylindrical core body 1 due to gravity also becomes less, and it is possible to make the film thickness uniform in both the circumferential direction and the axial direction.

Figure 3:
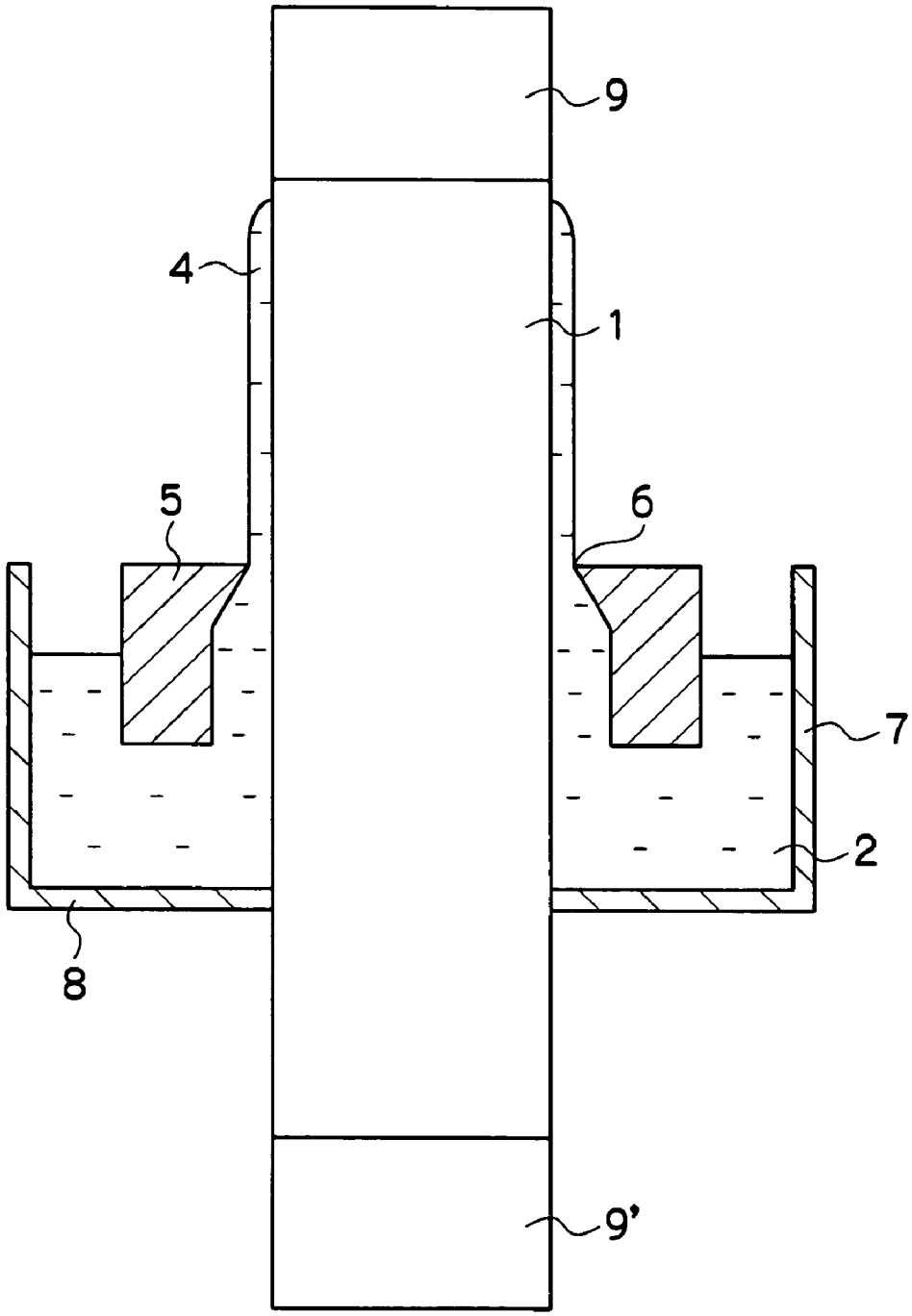
FIG. 3 is an outline cross-sectional view showing an additional example of a device used in the dip coating method in which film thickness is controlled by a cylindrical body.

In the PI precursor coating formation process, an annular application method can be applied. FIG. 3 is an outline cross-sectional view showing an example of a device used in the annular application method.

In FIG. 3, the difference from FIG. 2 is in that an annular seal material 8 having a hole that is somewhat smaller than the outer diameter of the cylindrical core body 1, is provided in the bottom of an annular application tank 7. The cylindrical core body 1 is inserted through the center of the annular seal material 8, and the PI precursor solution 2 is accommodated in the annular application tank 7. As a result, the PI precursor solution 2 does not leak. The cylindrical core body 1 is sequentially thrust up from the bottom to the top of the annular application tank 7, and as a result of passing through the annular body 5, the PI precursor coating 4 is formed on the surface. Intermediate bodies 9 and 9' that can engage with the cylindrical core body 1 may be installed above and below the cylindrical core body 1. The function of the annular body 5 and the circular hole 6 is the same as mentioned above.

In such an annular application method, the annular application tank 7 can be made smaller than the dip coating tank 3 of FIG. 2. Therefore there is an advantage in that the necessary quantity of the PI precursor solution is less.

(Centrifugal Molding)

Centrifugal molding is an application method that is preferable from the point of the film thickness uniformity in the case of formation of belts of a large diameter, smoothness provided by the surface design of the mold, and compatibility to multilayering to two or more layers.

Figure 4A:
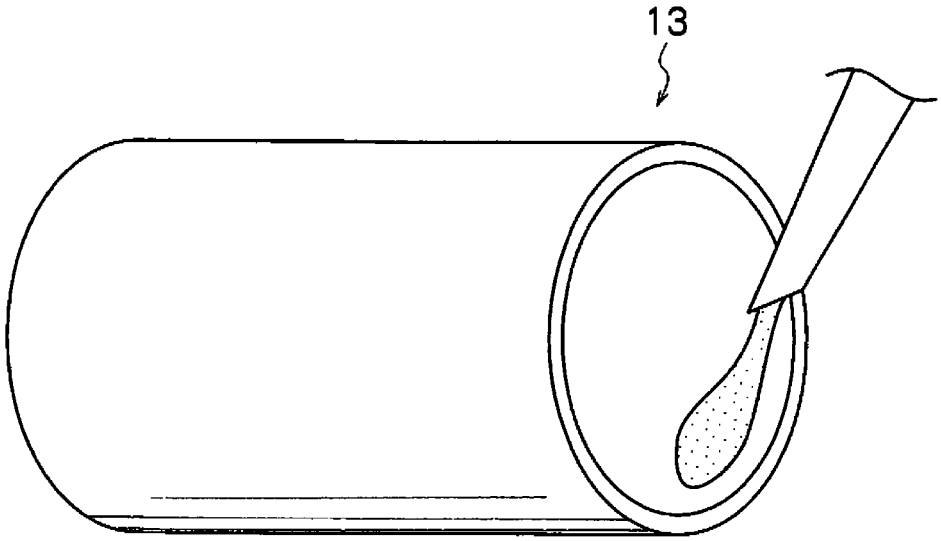
FIGS. 4A and 4B are explanatory drawings explaining an example of the flow of a coating method that utilizes a centrifugal molding method.
Figure 4B:
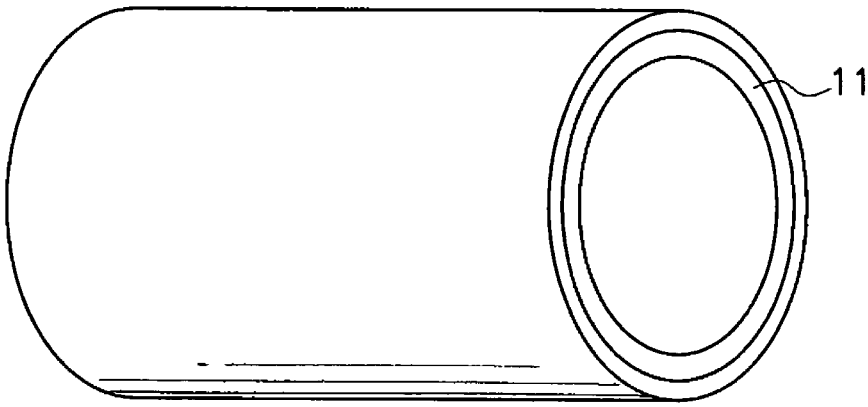

In FIGS. 4A and 4B, an example of the flow of an application process utilizing the centrifugal molding method is shown. Firstly, a cylindrical mold 13 is charged with the PI precursor solution (FIG. 4A). The cylindrical mold 13 is rotatable by a driving motor or the like, about the cylindrical axis. Furthermore, the mold 13 is positioned within a furnace or the like, and can be heated simultaneous with rotation. By rotating this mold 13, the wet coating 11 is formed on the interior wall surface (FIG. 4B).

If the interior wall surface of the cylindrical mold 13 is smoothened, by for example executing a lining process using a silicone resin, or the like, the film surface that is finally obtained can be made a mirror finish. As a result, thereafter, a conductive belt of an Rz value of 1 μm or less, having a high surface smoothness, can be manufactured without performing a surface polishing process or the like. Furthermore, film thickness changes at the time of molding may be suppressed, and it becomes possible to suppress axial fluctuations and the like during molding.

<Curing Process>

In the present process, for example, in the case of the polyimide resin film formation, the polyimide resin film can be formed by thermally reacting the polyimide precursor wet coating for 20 to 60 minutes, preferably within a range of 300 to 450° C., and more preferably at approximately 350° C. At the time of the thermal reaction, since swelling can occur in the polyimide resin film if there are polar aprotic solvents remaining, it is preferable to completely remove the residual solvent before the final temperature of heating is reached. Specifically, it is possible to remove the residual solvent by baking for 30 to 60 minutes at a temperature within a range of 150 to 200° C. before heating, and thereafter, to form the polyimide resin film by heating, in which the temperature is raised in stages, or at a fixed rate.

At this point, in the present invention, the surface water contact angle of the cylindrical core body is decreased at the end portions compared to the central portion, and since the adhesion and the adhesiveness of the wet coating and the resin film is high at the end portion in the entire perimeter area, contraction of the film resulting from the thermal reaction does not occur, and furthermore, unevenness of contractions are also not observed.

In relation to the contractions of the film that occur before and after the thermal reaction, it is preferable for the axial direction contraction coefficient of the cylindrical core body with respect to the resin wet coating to be 6% or less, and it is more preferable for it to be 3% or less. If the contraction coefficient exceeds 6%, in some cases, the film thickness deviation in the axial direction of the cylindrical core body becomes 10 μm or more, and the volume resistivity deviation in the axial direction becomes 0.5 digits or more. The axial contraction coefficient of the cylindrical core body with respect to the resin wet coating, when the axial length of the cylindrical core body of the resin film is denoted by C, and the axial length of the cylindrical core body of the wet coating is denoted by D, is obtained from $[(D-C)/D]\times100$.

<Separation Process>

Following the curing process, by cooling the cylindrical core body to room temperature, and undergoing the present process that detaches the formed resin film, the seamless tubing of the present invention can be obtained. In the present process, the cylindrical core body contracts less than the resin film following cooling, and the resin film can be extracted from the cylindrical core body. At this time, in the present invention, since the surface water contact angle of the cylindrical core body end portions is above a certain level, it is not difficult to separate the resin film, and it is not necessary to perform peeling by inserting a sheet, or the like, into at least one of the sections that are attached to both end portions of the cylindrical core body.

Regarding the extracted resin film, there are cases in which both ends thereof are inferior in uniformity of film thickness, and film debris is adhered thereto. Therefore these sections are cut off as unnecessary sections. In the present invention, the unnecessary sections may be within a range of 30 to 40 mm from the end portions.

The unnecessary sections of the end portions are cut off, and the inkjet conveying belt of the present invention is obtained, and a perforation (punching) process, a ribbing process, or the like, is executed as necessary.

The outer diameter of the inkjet conveying belt of the present invention that is manufactured in the above manner is correspondingly determined by the inner diameter of the cylindrical core body. However, it is preferably within the range of 10 mm to 1000 mm, and more preferably within the range of 15 mm to 600 mm. Having the inner diameter of the seamless tubing within the range of 10 mm to 1000 mm is preferable for forming a uniform film thickness.

Furthermore, it is preferable for the thickness of the inkjet conveying belt to be within the range of 10 to 100 μm, and more preferable within the range of 20 to 80 μm. Having the thickness of the seamless tubing within the range of 10 to 100 μm is preferable for forming a uniform film thickness.

[Inkjet Recording Apparatus]

Figure 5:
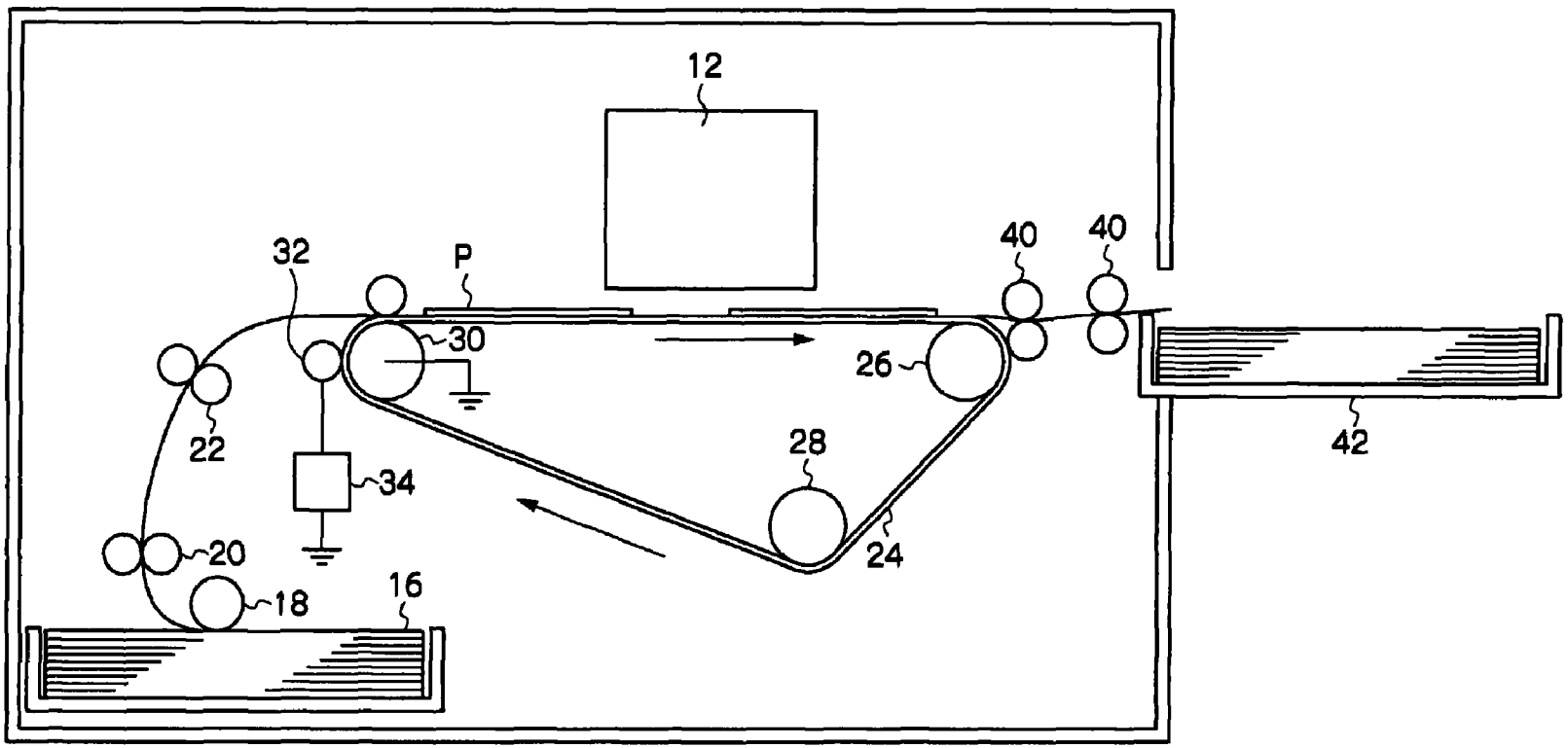
FIG. 5 is a schematic view showing the configuration of an inkjet recording apparatus according to an embodiment of the present invention.

As shown in FIG. 5, the inkjet recording apparatus 10 of the present invention is furnished with an inkjet head unit 12 that discharges ink droplets onto the recording paper P, which is the recording medium, and the inkjet head unit 12 is furnished with an inkjet head (not shown in the drawings) which discharges ink droplets of the four colors of cyan (C), magenta (M), yellow (Y), and black (K) respectively onto the recording paper P from nozzles. The inkjet head is a long length head having an effective printing area greater than the width of the recording paper P, and simultaneously discharges the ink droplets onto the printing area in the width direction of the recording paper P. Furthermore, in regard to the method of discharging the ink fluid from the nozzle of the inkjet head, commonly known methods, such as a method in which the ink chamber is pressurized by a piezoelectric element, or a thermal method, are applicable.

The ink is supplied to the inkjet head from an ink tank (not shown in the drawings) which is positioned above the inkjet head unit 12, through piping. For the type of ink, conventionally known inks, such as water-based ink, oil-based ink, and solvent type ink, are applicable.

A paper feeding tray 16 is provided on the bottommost portion of the inkjet recording apparatus 10 such that it can be inserted and extracted. Recording paper P is loaded into the paper feeding tray 16, and a pick up roll 18 makes contact with the topmost recording paper P. The recording paper P is fed one sheet at a time from the paper feeding tray 16 to the transport direction downstream side by the pick up roll 18, and it is fed to the lower side of the inkjet head unit 12 by transport rolls 20 and 22 that are sequentially arranged along the transport route.

On the lower side of the inkjet head unit 12, an endless conveying belt 24, which is the inkjet conveying belt of the present invention, is provided. The conveying belt 24 is spanned around a driving roll 26 and following rolls 28 and 30, to form the recording medium transport device. The following roll 30 is grounded.

A charging roll 32 with a power supply device 34 connected, is positioned on the upstream side of a position at which the recording paper P makes contact with the conveying belt 24. The conveying belt 24 is sandwiched and driven between the charging roll 32 and the following roll 30, and the charging roll 32 is movable between a pressed position where it presses the conveying belt 24, and a cleared position where it is cleared from the conveying belt 24. At the pressed position, a predetermined potential difference is generated between charging roll 32 and the grounded following roll 30. Therefore, it discharges with respect to the conveying belt 24, and can apply an electric charge. The position at which the charging roll 32 is positioned is explained with the example of a case where it is on the upstream side of the position at which the recording paper P makes contact with the conveying belt 24. However, it is in no way restricted by this, and it may be arranged at a location at which the effect of contamination from within the device, such as paper dust and ink mist, becomes less. The power supply device 34 is configured by a known arbitrary waveform generator that generates an arbitrary voltage waveform, and an amplifier.

On the downstream side of the inkjet head unit 12 is provided a plurality of ejection roll pairs 40 which constitute the ejection route of the recording paper P, and ahead of the ejection route configured by the ejection roll pairs 40, is provided an ejected paper tray 42.

Figure 6:
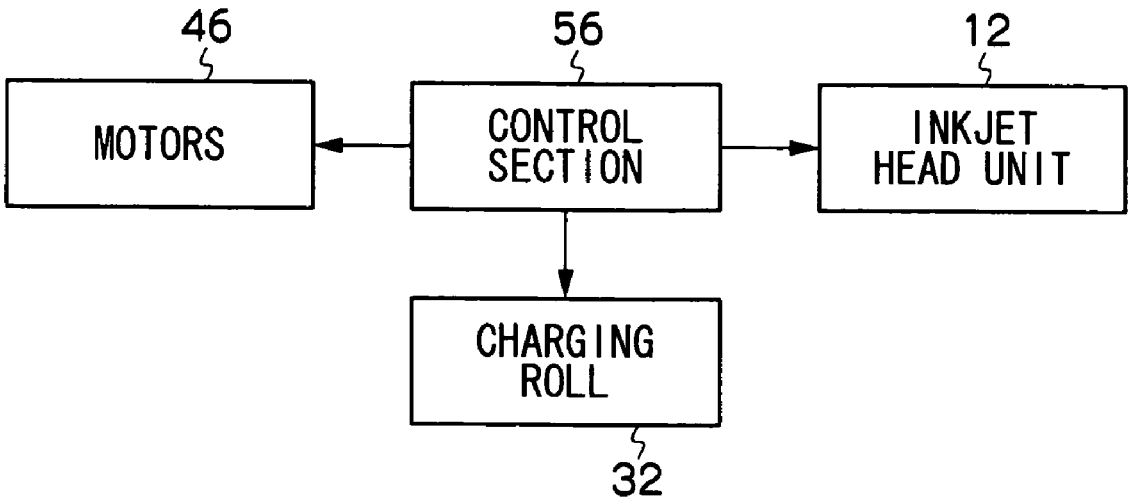
FIG. 6 is a block diagram showing a control system of an inkjet recording apparatus according to an embodiment of the present invention.

As shown in FIG. 6, the parts of the inkjet recording apparatus 10 are controlled by a control section 56 comprising a CPU, a ROM, and a RAM, which controls the entire inkjet recording apparatus 10 including the inkjet head unit 12, the charging roll 32, and the plurality of motors 46 that drive the various rolls.

Next, the printing operation of the inkjet recording apparatus 10 is explained. Firstly, when the control section 56 receives a print job command, it drives the pick up roll 18, all of the transport rolls, and the conveying belt 24, and sends through a recording paper P from the paper feeding tray 16. Furthermore, the head control section (not shown in the drawings) which performs a dummy jet, initializes the function of the nozzle of the inkjet head unit 12, and controls the discharging of the ink droplets by the inkjet head unit 12, applies to the piezoelectric element of the nozzle, which corresponds to the image signal, a driving voltage at a timing corresponding to the image signal.

As a result, the recording paper P being transported by the conveying belt 24 is printed. This printing process is described below in detail. Then, the printed recording paper P is transported to the ejected paper tray 42 by the conveying belt 24 and the ejection roll pairs 40.

Figure 7:
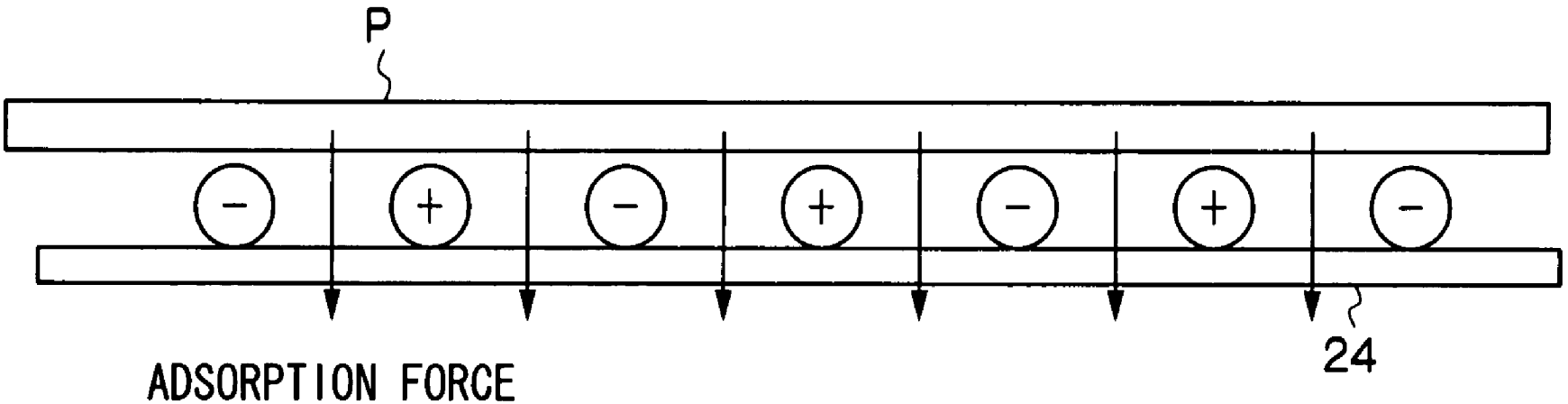
FIG. 7 is an image diagram showing electric charge that is charged on a conveying belt according to an embodiment of the present invention.

Here, the printing process is explained. Firstly, when the control section 56 receives a print job, it turns on the charging roll 32, and a voltage that changes with the superimposed waveform mentioned above, is applied from the power supply device 34 to the charging roll 32. Then, when the charging roll 32 discharges to the conveying belt 24, in regard to the charged area on the surface of the conveying belt 24, due to the voltage which changes with a high frequency voltage having a superimposed waveform, the residual electrical charge is averaged and only the charging pattern corresponding to the frequency of the low frequency voltage waveform appears at the belt surface, and as shown in FIG. 7, the surface of the conveying belt 24 is alternately charged with a positive electrical charge and a negative electrical charge. As a result of the stress (Maxwell stress) from the nonuniform electrical field resulting from this positive electrical charge and negative electrical charge, the recording paper P is stably electrostatically adsorbed on the surface of the conveying belt 24. Since the positive electrical charge and the negative electrical charge is alternately charged, the effect of the electrical field applied from the surface of the conveying belt 24 on the discharging of the ink droplets from the inkjet head unit 12 is small. Furthermore, since the recording paper P is not directly charged, the effect on the adsorption force originating from the characteristics (electrical resistance, thickness, and the like) of the recording paper P is small.

As a result, the recording paper P fed to the conveying belt 24 is electrostatically adsorbed on the conveying belt 24, and passes the printing area of the inkjet head unit 12. At this time, the control section 56 operates the inkjet head unit 12, and performs printing of the recording paper P. Then the recording paper P is ejected to the ejected paper tray 42 by the ejecting roll pairs 40. Furthermore, the section of the conveying belt 24 in which the recording paper P was adsorbed is rotatingly moved again to the pressing section of the charging roll 32 by the driving roll 26 and the following rolls 28 and 30, and due to the voltage applied to the charging roll 32, which changes with a superimposed waveform, the electrical charge remaining on the conveying belt 24 is averaged, and once again a positive electrical charge and a negative electrical charge is alternately charged on the conveying belt 24 corresponding to the frequency of the low frequency waveform, and a stable adsorptive strength is maintained.

EXAMPLES

Hereunder, the present invention is explained in detail by way of examples, but the present invention is in no way restricted by these. In the examples, "parts" refers to parts by mass.

Example 1

In the manufacture of the seamless tubing, a silicone type resin is spray coated as a mold releasing material on the outer peripheral face of an Al made cylindrical core body of an outer diameter of 250 mm, and a length of 250 mm, such that it became 1 μm, and is baked at 380° C. for 1 hour.

To the cylindrical core body, 100 parts by mass of the polyimide precursor (manufactured by Ube Industries: U Varnish S, 18 mass % NMP solution), and 23 parts of carbon black (Special Black 4 manufactured by Degussa) are mixed, and a carbon black dispersed polyimide precursor solution is obtained. As shown in FIGS. 1A and 1B, while rotating the cylindrical core body at 100 rpm, and while moving in the axial direction from the end portion of the core body at 150 mm/min, the polyimide precursor solution is applied such that the coating thickness became 0.5 mm.

Following application, by heating at 380° C. for 1 hour, a belt with a volume resistivity of $10^{10}$. $^{8}\Omega$cm and a surface resistivity of $10^{11}$. $^{2}\Omega/cm^2$ is obtained. This is extracted, and an inkjet conveying belt of a circumference of 765 mm and a width of 365 mm is produced by cutting off the end portions.

The volume resistivity is made the average value of 9 points measured for each of the belt circumferential direction and the axial direction under an environment of 23° C., 55% RH using a cylindrical electrode HR probe of a HIRESTA-IP manufactured by Mitsubishi Petrochemical Co. Ltd. using the values of a load of 1 kg, and a voltage of 100 V (10 second charge). The surface resistivity is measured in the same manner as the volume resistivity, by measuring the resistance between the outer electrodes and the inner electrodes using an HR probe as the opposing electrode under the same conditions, and averaging the measured values. Furthermore, the gloss measured by a digital precision Gloss Meter manufactured by Murakami Color Research Center, is 118.

The inkjet conveying belt is installed in an inkjet image forming apparatus, an image is formed, and the image quality thereof is evaluated. Furthermore, the adsorptivity of the paper with respect to the DC voltage (3 kV) fed to the surface of the inkjet conveying belt is observed, and the detachability following printing is evaluated. The results are shown in Table 1 below. From Table 1, it could be confirmed that a satisfactory paper adsorptivity is obtained, and a satisfactory image is obtained. Furthermore, at the time of volume resistivity measurement, the difference between the measured values at the time of LL (10° C., 15% RH) and at the time of A (28° C., 86% RH) is examined. The results are shown in Table 1 below. In the case where the difference (LL−A) is 1.5 digits or less, the changes in paper adsorptivity resulting from the environment is small, signifying that the effects of surface charge remaining as a result of paper detaching discharge at the time of detachment, and the discharging thereof, is satisfactory.

Examples 2 and 3

Other than changing the carbon black filling quantity of the polyimide precursor solution of Example 1 as shown in Table 1 below, the inkjet conveying belt is manufactured in the same manner as Example 1, and evaluations are performed. As shown in Table 1, satisfactory paper adsorptivities and images are obtained. The gloss of the inkjet conveying belt of Example 2 is 95, and the gloss of the inkjet conveying belt of Example 3 is 107.

Example 4

U Varnish A is used as the polyimide precursor, and as shown in FIGS. 4A and 4B, on the inner circumferential face of an Al made cylindrical core body of an interior diameter of 250 mm and a length of 500 mm, following application of a silicone resin mold releasing material in the same manner, thermal film production is performed at 120° C. for 30 minutes while rotating at 3000 rpm, and following cooling to room temperature, it is further baked at 380° C. for 1 hour. Thereafter, the inkjet conveying belt is manufactured by cutting in the same manner as Example 1, and upon evaluation, as shown in Table 1 below, a satisfactory paper adsorptivity and image is obtained. The gloss of the inkjet conveying belt of Example 4 is 88.

Comparative Examples 1 and 2

Other than adjusting the carbon black quantity as shown in Table 1 below, the inkjet conveying belt is manufactured in the same manner as Example 1, and the paper adsorptivity thereof, and the like, is evaluated. In Comparative Example 1, the belt resistance is low and the paper did not sufficiently adsorb. In Comparative Example 2, since the resistance is high, a sufficient paper detachability could not be obtained. The gloss of the inkjet conveying belt of Comparative Example 1 is 65, and the gloss of the inkjet conveying belt of Comparative Example 2 is 70.

Comparative Example 3

Other than adjusting the carbon black quantity as shown in Table 1 below, the inkjet conveying belt is manufactured in the same manner as Example 4, and the paper adsorptivity thereof, and the like, is evaluated. As a result, the belt resistance is low, and the paper adsorptivity could not be obtained. The gloss of the inkjet conveying belt of Comparative Example 3 is 68.

TABLE 1

| | Example 1 | Example 2 | Example 3 | Example 4 | Comparative example 1 | Comparative example 2 | Comparative example 3 |
|---|---|---|---|---|---|---|---|
| Polyimide precursor solution | Ube Industries: U Varnish S: 100 parts Degussa carbon black: 23 parts | Ube Industries: U Varnish S: 100 parts Degussa carbon black: 20 parts | Ube Industries: U Varnish S: 100 parts Degussa carbon black: 15 parts | Ube Industries: U Varnish A: 100 parts Degussa carbon black: 20 parts | Ube Industries: U Varnish S: 100 parts Degussa carbon black: 30 parts | Ube Industries: U Varnish S: 100 parts Degussa carbon black: 10 parts | Ube Industries: U Varnish A: 100 parts Degussa carbon black: 28 parts |
| Film thickness (μm) | 83 | 85 | 78 | 78 | 82 | 76 | 80 |
| Film forming method | Flow coat | Flow coat | Flow coat | Centrifugal molding | Flow coat | Flow coat | Centrifugal molding |
| Surface resistivity (log $\Omega/cm^2$) | 11.2 | 12.5 | 13.5 | 12.8 | 10.5 | 14.6 | 9.8 |
| Volume resistivity (log Ωcm) | 10.8 | 11.5 | 11.8 | 11.2 | 9.4 | 14.1 | 9.2 |
| Environmental change ΔLL-A | 0.5 | 0.8 | 0.7 | 0.6 | 0.4 | 1.2 | 0.3 |
| Paper adsorptivity | Satisfactory | Satisfactory | Satisfactory | Satisfactory | Unacceptable (paper detaching) | Unacceptable (no discharge) | Unacceptable (Immediate discharge) |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

The invention claimed is:

1. A single-layer seamless inkjet conveying belt comprising a single seamless layer including a polyamide-imide resin as a resin component and a conductive filler, the inkjet conveying belt having a volume resistivity of about $10^{10}$ to $10^{14}$ Ωcm, and the surface of the conveying belt being alternatively charged with a positive electrical charge and a negative electrical charge by a charging device that applies a voltage that changes with a superimposed waveform.

2. The inkjet conveying belt according to claim 1, having surface smoothness that gives a gloss of about 75 or more at an angle of incidence of 75 degrees.

3. The inkjet conveying belt according to claim 2, having a thickness of about 30 to 1000 gm.

4. The inkjet conveying belt according to claim 2, having a thickness of about 50 to 200 gm.

5. The inkjet conveying belt according to claim 1, having a surface resistivity of about $10^{11}$ to $10^{14}$ $\Omega/cm^2$.

6. The inkjet conveying belt according to claim 1, wherein the inkjet conveying belt is manufactured by any one of a flow coating method, a ring flow coating method, or a centrifugal molding method.

7. An inkjet recording apparatus comprising a recording medium conveying device containing the inkjet conveying belt of claim 1 and a recording head that discharges ink droplets onto a recording medium.

8. The inkjet recording apparatus according to claim 7, wherein the inkjet conveying belt has surface smoothness that gives a gloss of about 75 or more at an angle of incidence of 75 degrees.

9. The inkjet recording apparatus according to claim 8, wherein the inkjet conveying belt has a thickness of about 30 to 1000 μm.

10. The inkjet recording apparatus according to claim 8, wherein the inkjet conveying belt has a thickness of about 50 to 200 μm.

11. The inkjet recording apparatus according to claim 7, wherein the inkjet conveying belt has a surface resistivity of about $10^{11}$ to $10^{14}\Omega/cm^2$.

12. The inkjet recording apparatus according to claim 7, wherein the inkjet conveying belt is manufactured by any one of a flow coating method, a ring flow coating method, or a centrifugal molding method.

13. The inkjet recording apparatus according to claim 7, wherein the resin component is a polyimide resin composed of an aromatic tetracarboxylic acid component and an aromatic diamine component.

14. A single-layer seamless inkjet conveying belt comprising: a single seamless layer including as a resin component a polyamide-imide resin and a polyimide resin composed of an aromatic tetracarboxylic acid component and an aromatic diamine component and a conductive filler, the inkjet conveying belt having a volume resistivity of about $10^{10}$ to $10^{14}$ Ωcm, and the surface of the conveying belt being alternatively charged with a positive electrical charge and a negative electrical charge by a charging device that applies a voltage that changes with a superimposed waveform.

* * * * *